US011125024B2

(12) United States Patent
Kellner et al.

(10) Patent No.: US 11,125,024 B2
(45) Date of Patent: Sep. 21, 2021

(54) CENTRALIZER WITH DISSOLVABLE RETAINING MEMBERS

(71) Applicant: INNOVEX DOWNHOLE SOLUTIONS, INC., Houston, TX (US)

(72) Inventors: Justin Kellner, Adkins, TX (US); Iain Levie, Spring, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 31 days.

(21) Appl. No.: 16/523,193

(22) Filed: Jul. 26, 2019

(65) Prior Publication Data

US 2021/0025244 A1 Jan. 28, 2021

(51) Int. Cl.
*E21B 17/10* (2006.01)
*E21B 23/01* (2006.01)

(52) U.S. Cl.
CPC ..... *E21B 17/1028* (2013.01); *E21B 23/01* (2013.01)

(58) Field of Classification Search
CPC ... E21B 17/1028; E21B 17/1078; E21B 23/01
See application file for complete search history.

(56) References Cited

U.S. PATENT DOCUMENTS 5,261,488 A * 11/1993 Gullet ..... E21B 17/1028 166/241.7
2015/0034336 A1* 2/2015 Morrison ..... E21B 17/1014 166/381
2017/0234082 A1* 8/2017 Hope ..... E21B 17/10 166/285
2018/0078998 A1* 3/2018 Sherman ..... B22D 21/007
2021/0025245 A1* 1/2021 Mackay ..... E21B 17/1028

* cited by examiner

*Primary Examiner* — D. Andrews
(74) *Attorney, Agent, or Firm* — MH2 Technology Law Group LLP

(57) ABSTRACT

A downhole tool may include a first end collar configured to be positioned at least partially around a tubular, a second end collar configured to be positioned at least partially around the tubular, a plurality of elongate members extending between and connected to the first and second end collars, and a dissolvable retention member coupled to the second end collar. The dissolvable retention member is configured to maintain a position of the second end collar relative to the first end collar until the dissolvable retention member at least partially dissolves in a downhole fluid. When the dissolvable retention member at least partially dissolves, the second end collar is configured to move with respect to the first end collar, and the plurality of elongate members expand radially outwards.

15 Claims, 9 Drawing Sheets

CENTRALIZER WITH DISSOLVABLE RETAINING MEMBERS

BACKGROUND

Centralizers may be used in the processes of oil and gas exploration and production for maintaining a segment of drill pipe, casing, or another tubular in a substantially centralized position relative to a surrounding tubular (e.g., a borehole wall, well casing, liner, etc.). For example, when centralizers are used with casing, once the casing is in place, cement may be run into the annulus between the casing and the wellbore wall, with the centralizer maintaining the annulus around the casing, so as to provide an area with a generally uniform thickness for the cement to fill.

A bow-spring centralizer is one type of centralizer, which includes bow springs that press against an outer wall and exert a radial inward force on the tubular, such that the tubular tends to be held away from the wall. Bow-spring centralizers generally include a pair of end collars, between which the flexible bow springs extend. The end collars may not be fixed to the casing, but allowed to slide across a range of motion and rotate.

In bow-spring centralizers, so long as at least one of the end collars is free to slide longitudinally with respect to the other end collar, the centralizer is capable of being compressed inwardly, and thereby progress through passages that are narrower than the diameter of the centralizer in an uncompressed state. Provided that such a centralizer is not plastically deformed when passing through a narrow region, the centralizer can thus be used in a range of borehole diameters.

When navigating through restrictions in a wellbore, it may be desirable for centralizers to be pulled through, rather than pushed, as pushing tends to add more friction and require more load to run the casing thus limiting the number of centralizers that may be run. Some centralizers may include one or two stop collars (e.g., a small cylinder) that the centralizer can slide up against.

SUMMARY

In accordance with one aspect, a downhole tool may include a first end collar configured to be positioned at least partially around a tubular, a second end collar configured to be positioned at least partially around the tubular, multiple elongate members extending between and connected to the first and second end collars, and a dissolvable retention member coupled to the second end collar. The dissolvable retention member is configured to maintain a position of the second end collar relative to the first end collar until the dissolvable retention member at least partially dissolves in a downhole fluid. When the dissolvable retention member at least partially dissolves, the second end collar is configured to move with respect to the first end collar, and the plurality of elongate members expand radially outwards.

In accordance with another aspect, a system includes a tubular, and a centralizer positioned at least partially around the tubular. The centralizer includes a first end collar, a second end collar at an opposite distal end of the first end collar, multiple elongate bow-spring members between the first and second end collars, and at least one dissolvable retention member configured to retain the centralizer in a flat position until the dissolvable retention member dissolves. When the dissolvable retention member dissolves, the plurality of elongate bow-spring members extend radially outwards.

In accordance with another aspect, a method include securing a centralizer in a flat position on a tubular using one or more dissolvable retention members positioned within one or more slots or holes of the centralizer, and deploying the tubular with the centralizer into well after securing the centralizer in the flat position. The one or more dissolvable retention members dissolve in the well, causing the centralizer to actuate to a deployed position in which elongate members of the centralizer expand radially outwards from the flat position and engage a surrounding tubular.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits, and networks have not been described in detail so as not to unnecessarily obscure aspects of the embodiments.

In general, embodiments of the present disclosure may include a centralizer having first and second end collars and elongate, bow-spring members extending therebetween. The bow-spring members are temporarily retained in a flat position by dissolvable retention members, and run into the well. In the flat or run-in position, the bow-spring members are held in a stretched state, closely against an inner tubular, so as to minimize the positive outer diameter increase provided by the centralizers and thereby minimize contact with a surrounding tubular (e.g., casing, liner, wellbore wall, etc.). This may reduce or avoid drag forces generated by contract between the bow-spring members and the wellbore wall. As such, an increased number of centralizers may be run (e.g., in oil and gas wells, boreholes, etc.), thereby improving tubular centralization. Moreover, a reduction in drag may also allow an increased rate at which the casing can be run, thereby reducing run times and costs.

By retaining the bow-spring members in such a flat run-in position, different geometric run-in options may be possible. For example, a stronger (e.g., having a greater spring constant) bow-spring member may be employed, whereas previously, the starting (initiating movement) force and running force (continuing movement) induced by the centralizer contacting the surrounding tubular (e.g., in a restriction) may have been prohibitive. In this way, improved centralization may be achieved in under-reamed open hole applications, among other applications.

The dissolvable retention members hold the first and second end collars in position relative to one another, e.g., axially apart, thereby preventing the bow-springs from expanding radially outward. The inner tubular, with the centralizer positioned thereon, may then be run into a surrounding tubular in a well. Upon the dissolvable retention members dissolving (e.g., by interaction with a downhole fluid), at least one of the first and second end collars may be freed to move relative to the other. No longer held in a stretched, flat position by immobile end collars, the bow-spring members may spring outwards and form a curved shape configured to resiliently engage the surrounding tubular and centralize the inner tubular.

Figure 1B:
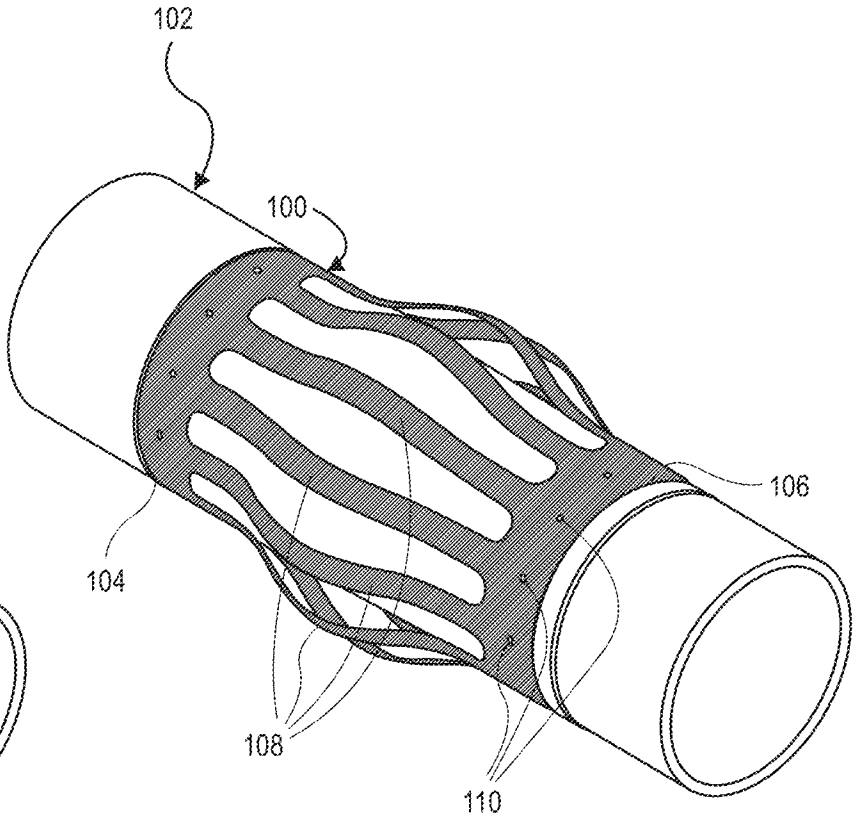
FIGS. 1A and 1B illustrate isometric views of a centralizer received around a tubular in a run-in position and a deployed position, respectively, according to an embodiment.
Figure 1A:
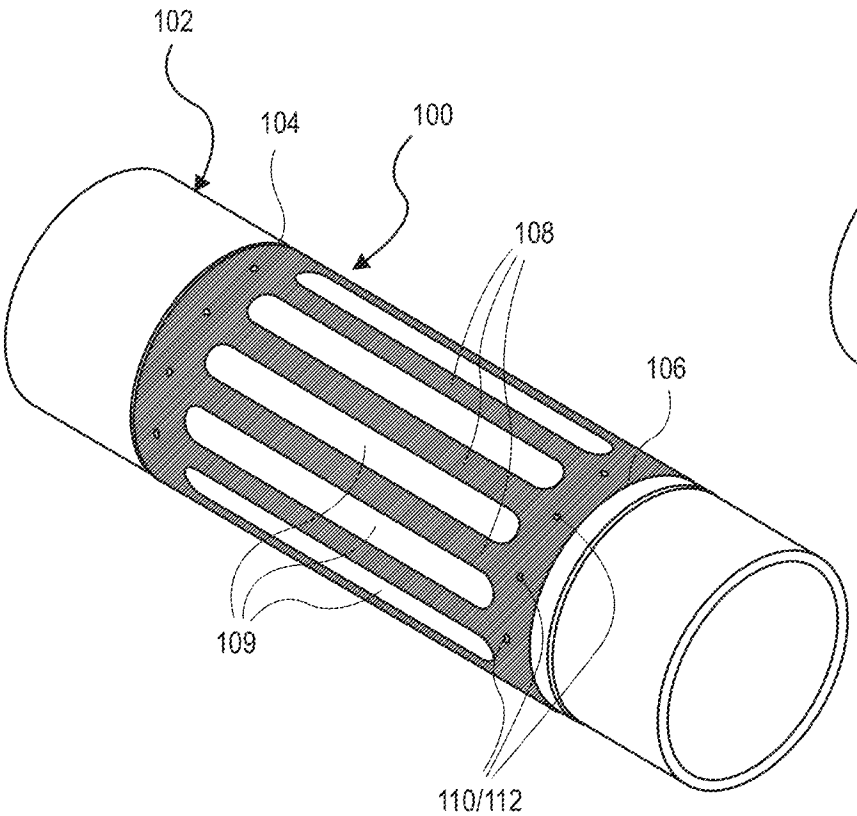

Turning now to the specific, illustrated embodiments, FIGS. 1A and 1B illustrate isometric views of a centralizer 100 (e.g., a downhole tool) positioned around a tubular 102, according to an embodiment. The tubular 102 may be any sort of oilfield tubular configured to be run into a wellbore, e.g., casing, drill pipe, production tubing, etc. The centralizer 100 may include a first end collar 104 and a second end collar 106, both of which are received at least partially around the tubular 102 and are axially offset from one another. Elongate members (e.g., bow-spring members 108) extend therebetween and are coupled to the first and second end collars 104, 106. The bow-spring members 108 may extend axially between and be connected to the first end collar 104 and the second end collar 106. In at least one embodiment, the bow-spring members 108 may be integrally formed with the end collars 104, 106. Furthermore, adjacent bow-spring members 108 may be separated circumferentially apart by slots 109 (e.g., rectangular gaps with rounded edges).

As used herein, "axial" refers to a direction parallel to a central longitudinal axis of the centralizer 100, which may be coincident with the longitudinal axis of the tubular 102 when the centralizer 100 is deployed thereon. By contrast, "radial" refers to a direction inwards/outwards from the central axis of the centralizer 100, i.e., perpendicular thereto.

The centralizer 100 may include dissolvable retention members 112 coupled to at least one of the first and second end collars 104, 106. For example, as shown, the dissolvable retention members 112 may be received through holes 110 formed through the second end collar 106 and into engagement with the tubular 102, as will be described in greater detail below. The dissolvable retention members 112 may be, for example, pins, lugs, or the like, and may be made from, for example, magnesium and/or other dissolvable materials.

The dissolvable retention members 112 may retain the bow-spring members 108 in the flat, run-in position by restraining the second end collar 106, thereby maintaining an axial separation between the first end collar 104 and the second end collar 106. For example, the dissolvable retention members 112 may hold the second end collar 106 stationary with respect to the tubular 102, as will be described in greater detail below. The first end collar 104 may likewise be held stationary with respect to the tubular 102, either by additional dissolvable retention members 112, by engagement with a stop collar, or by other structures/devices (e.g., set screws, adhesives, etc.), which may or may not be dissolvable. As such, when in the flat position, the first end collar 104 and the second end collar 106 are held separated axially apart by a first axial distance that is substantially equal to the flattened axial length of the bow-spring members 108.

FIG. 1B illustrates the centralizer 100 in a deployed position (e.g., after the centralizer 100 has been run into the well). As shown, the dissolvable retention members 112 may dissolve, thus freeing the second end collar 106 to move along the tubular 102. The first end collar 104 may likewise be released, or may continue to be held in place relative to the tubular 102. In either case, the axial distance between the first and second end collars 104, 106 may be variable since at least one of the end collars 104, 106 is movable (the two end collars 104, 106 may be considered to be relatively movable if at least one is free to move along the tubular 102). With the first and second end collars 104, 106 no longer held immobile with respect to one another, the stretched bow-spring members 108 may draw the first and second end collars 104, 106 closer together as the bow-spring members 108 expand or "flare out" radially and form a curved shape. In the deployed position, the first and second end collars 104, 106 may be separated by a second axial distance that is less than the first axial distance. In this way, the bow-spring members 108 may be deployed, e.g., to engage the surrounding tubular once the centralizer 100 has been run and positioned.

Figure 2B:
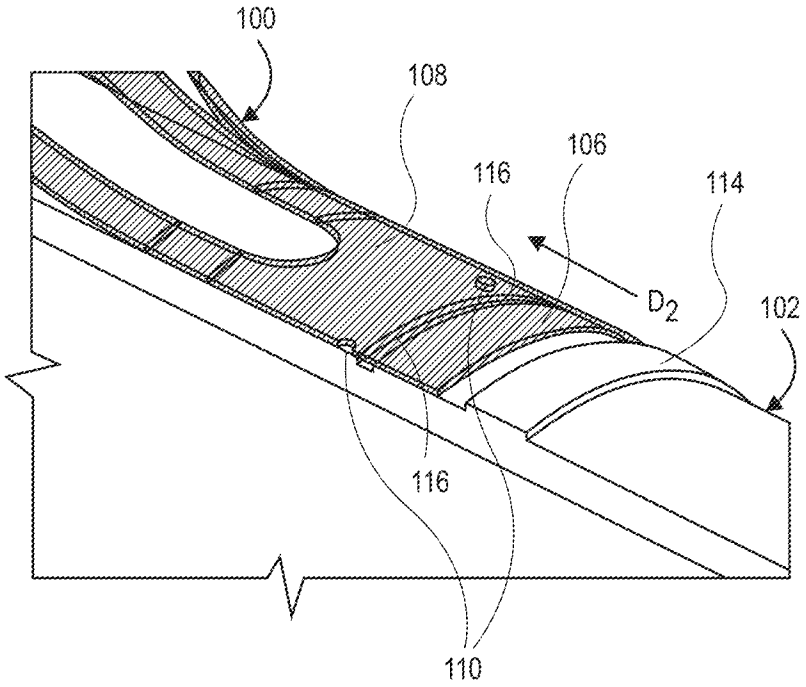
FIGS. 2A and 2B illustrate enlarged views of a portion of the centralizer in the run-in position and the deployed position, respectively, according to an embodiment.
Figure 2A:
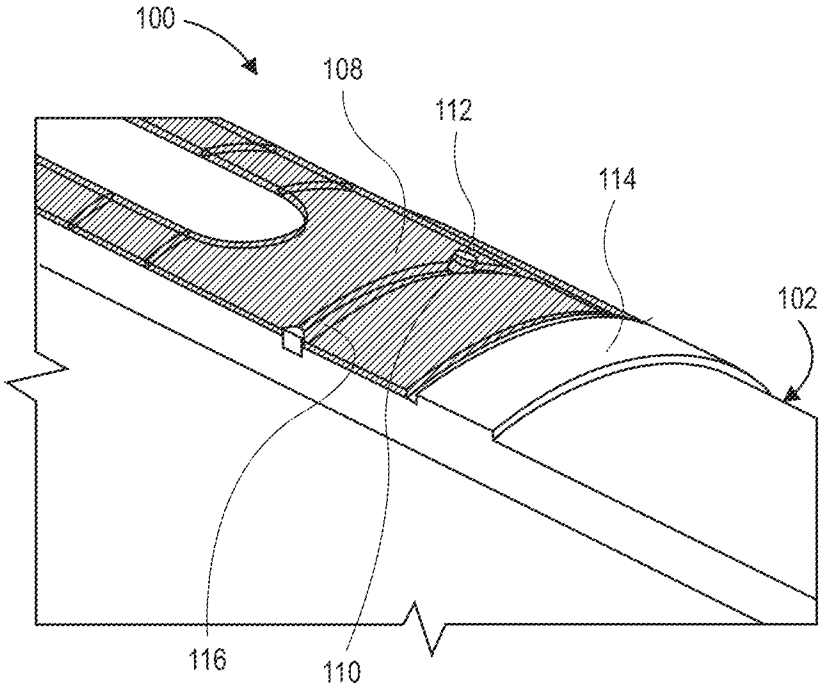

FIG. 2A illustrates an enlarged view of the second end collar 106 of the centralizer 100 in the flat, run-in position. As shown, the dissolvable retention members 112 may be received through the holes 110 in the second end collar 106, and into a groove 116 formed in the tubular 102. As such, the dissolvable retention members 112 may prevent axial displacement of the second end collar 106 relative to the tubular 102. As further shown in FIG. 2A, the tubular 102 may include a stop collar 114 that the centralizer 100 can slide up against, e.g., after the dissolvable retention members 112 dissolve. In some embodiments, the tubular 102 may include holes, rather than a groove 116, with the holes of the tubular 102 lining up with the holes 110 in the second end collar 106. This may prevent circumferentially movement of the second end collar 106 relative to the tubular 102. In still other embodiments, the tubular 102 may include holes and the holes 110 may be substituted with a slot extending at least partially circumferentially around the end collar 106.

FIG. 2B illustrates an enlarged view of the second end collar 106 of the centralizer 100 in the deployed position. As shown, the second end collar 106 may move axially upon the dissolvable retention members 112 dissolving. In particular, as the bow-spring members 108 flare outwards, the second end collar 106 may be forced towards the first end collar 104. In some embodiments, the first end collar 104 may be likewise released, and thus the second end collar 106 may be free to slide into engagement with the stop collar 114.

Figure 3B:
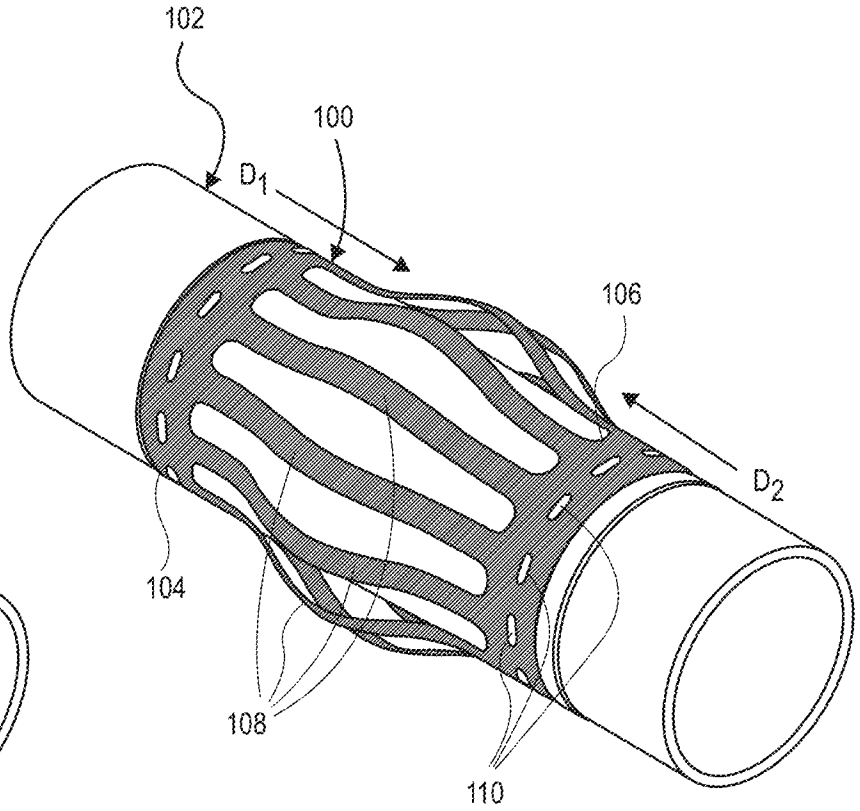
FIGS. 3A and 3B illustrate isometric views of another embodiment of the centralizer in a run-in position and a deployed position, respectively.
Figure 3A:
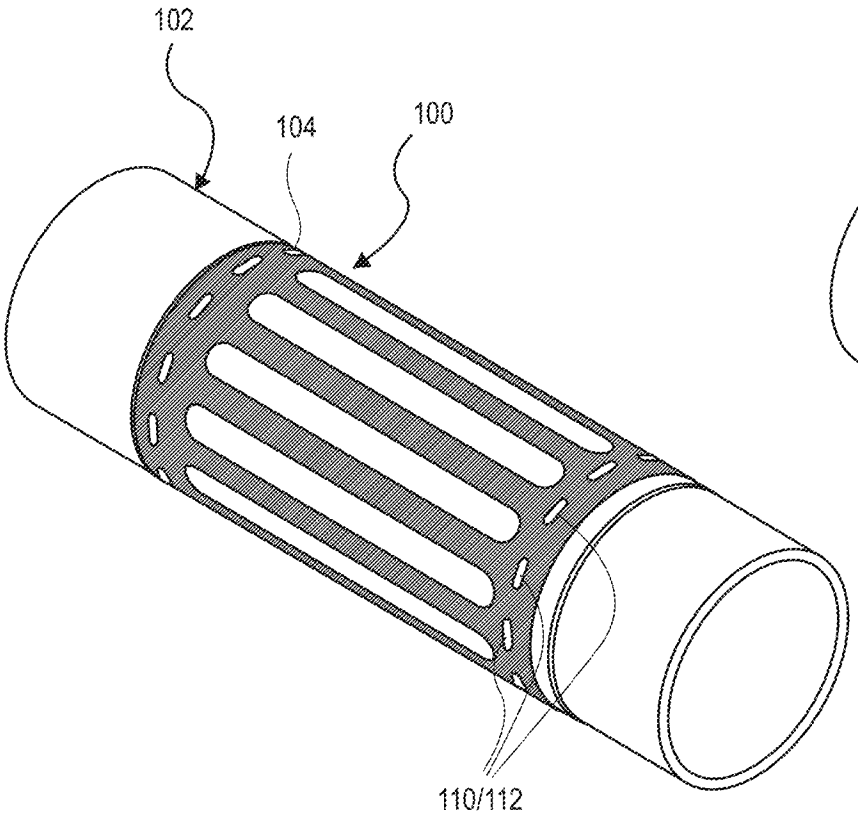

FIG. 3A illustrates an isometric view of another embodiment of the centralizer 100 in the flat, run-in position. FIG. 3B illustrates an isometric view of the centralizer 100 of this embodiment in the deployed position. As shown in FIG. 3A, the dissolvable retention members 112 be lugs that are coupled to the tubular 102. The holes 110 may be windows having a shape corresponding to the lug-shaped dissolvable retention members 112, such that the holes 110 may receive the dissolvable retention members 112. As shown in FIG. 3B, upon the dissolvable retention members 112 dissolving, the second end collar 106 may be freed to move toward the first end collar 104 (and/or vice versa, depending on where the dissolvable retention members 112 are positioned), allowing the bow-spring members 108 to flare out into the deployed position.

Figure 4B:
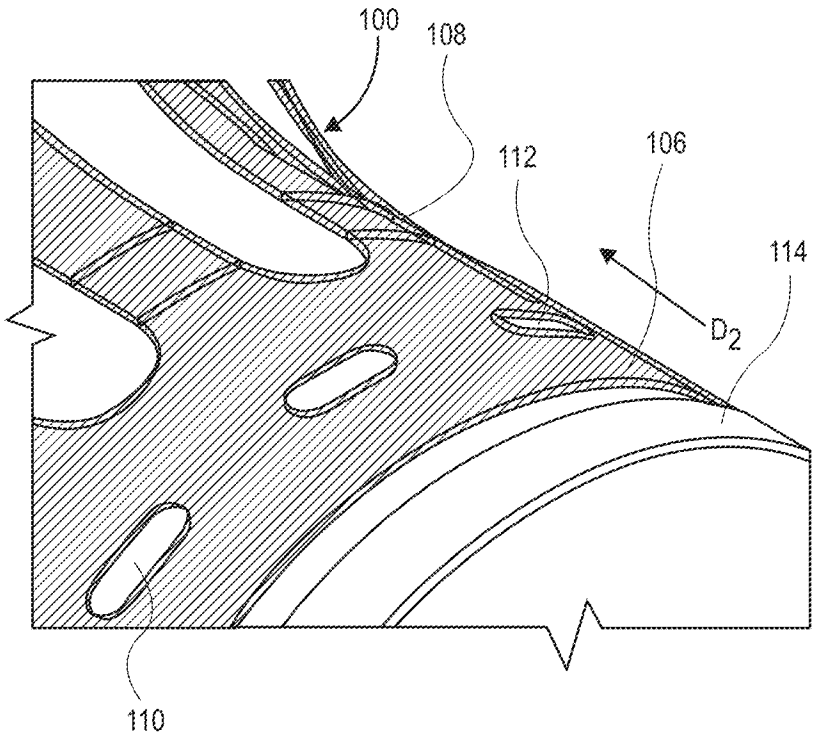
FIGS. 4A and 4B illustrate enlarged views of a portion of the centralizer embodiment of FIGS. 3A and 3B in a run-in position and a deployed position, respectively.
Figure 4A:
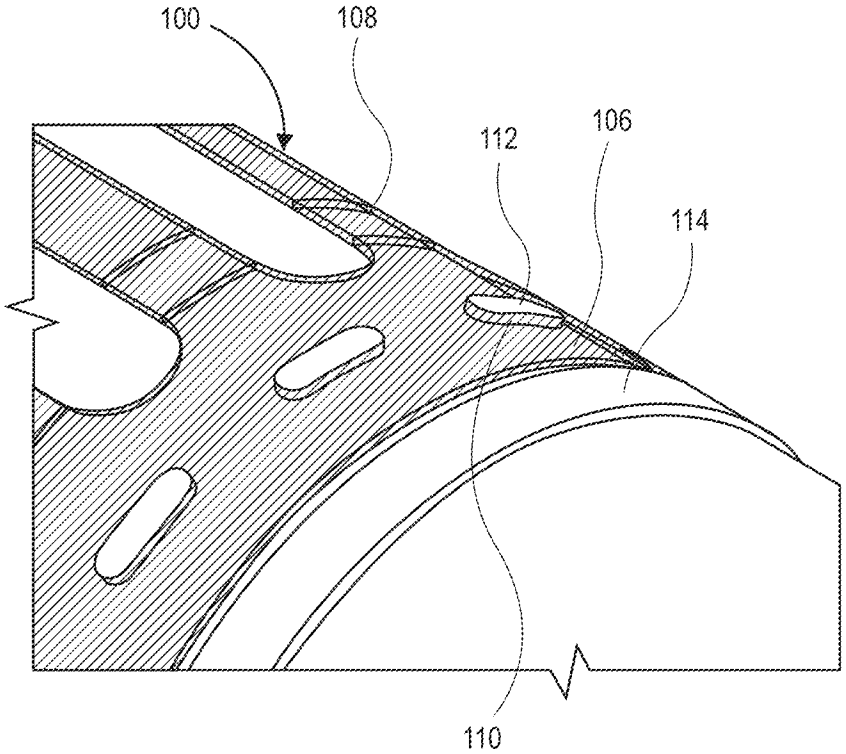

FIG. 4A illustrates an enlarged view of the second end collar 106 of the centralizer 100 of FIG. 3A in the flat, run-in position. FIG. 4B illustrates the second end collar 106 of this embodiment of the centralizer 100 in the deployed position. Referring to FIG. 4A, the lug-shaped dissolvable retention members 112 may extend through the holes 110. Referring to FIG. 4B, when the centralizer 100 is deployed, the dissolvable retention members 112 may dissolve, freeing the second end collar 106 to move along the tubular 102 and allowing the centralizer 100 to engage into the deployed position (e.g., by the bow-spring members 108 extending radially outwards).

Figure 5B:
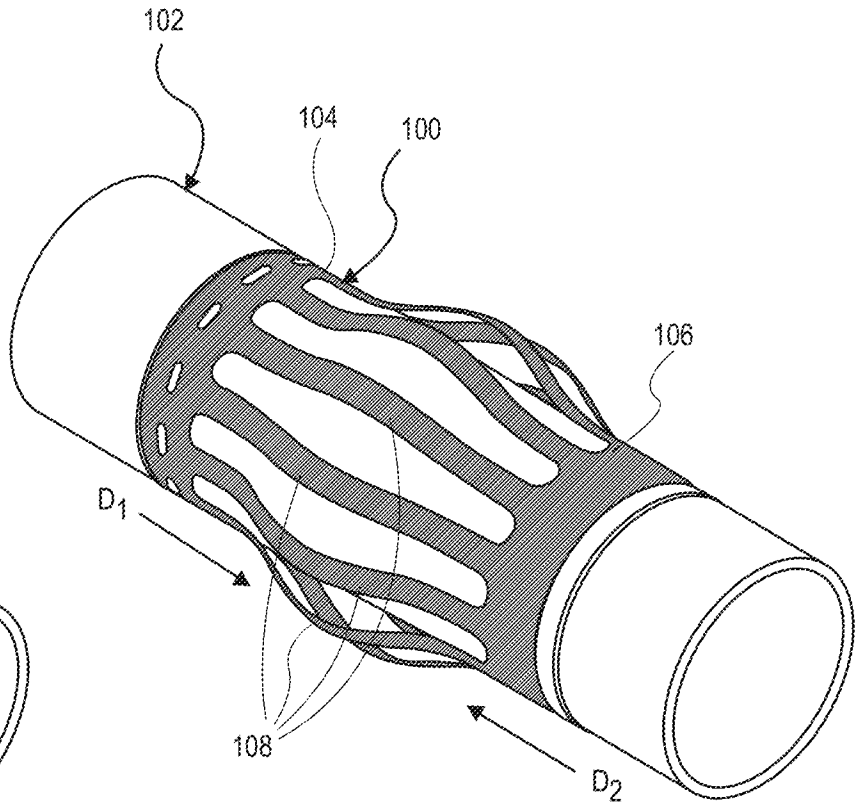
FIGS. 5A and 5B illustrate isometric views of another embodiment of the centralizer in a run-in position and a deployed position, respectively.
Figure 5A:
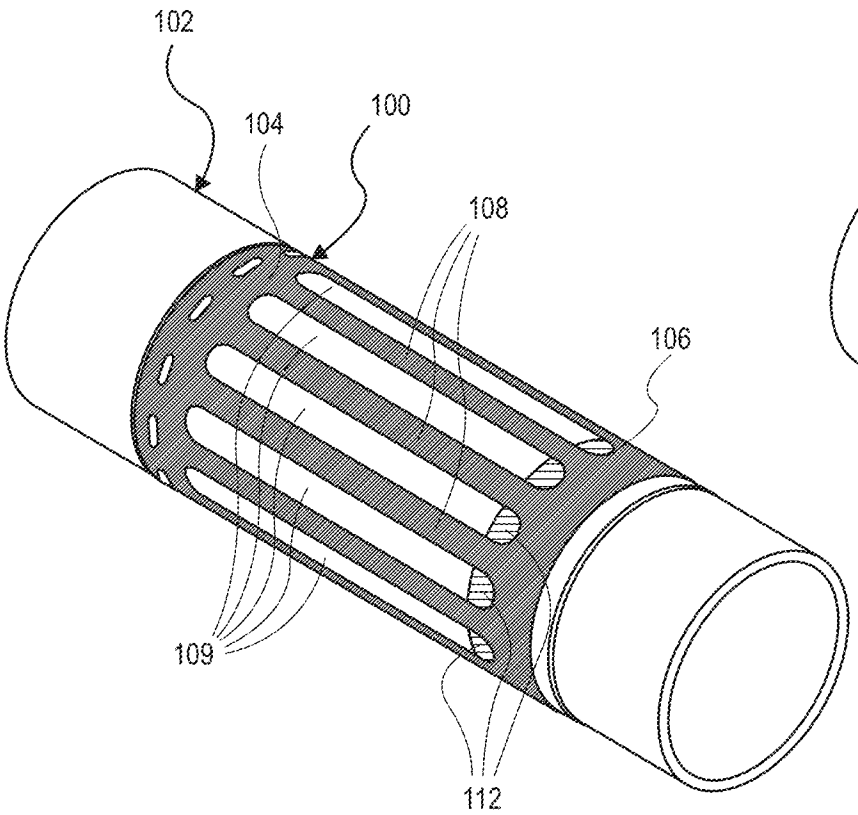

FIG. 5A illustrates an isometric view of another embodiment of the centralizer 100 in the flat, or run-in position. FIG. 5B illustrates an isometric view of this embodiment of the centralizer 100 in the deployed position. As shown in FIG. 5A, the dissolvable retention members 112 may be lugs which may be positioned separate from one another in the slots 109 between the bow-spring members 108, to hold the second end collar 104 from sliding towards the first end collar 104. Alternatively, a dissolvable retention member 112 may include an annular stop collar or ring that extends around the tubular 102, with the bow-spring members 108 extending over and axially past the stop collar/retention member 112 to the second end collar 106.

As shown in FIG. 5B, upon the dissolvable retention members 112 dissolving, the second end collar 106 may be freed to move toward the first end collar 104 (and/or vice versa). Accordingly, the stretched bow-spring members 108 may be free to expand outwards, drawing the first and second end collars 104, 106 toward one another.

Figure 6B:
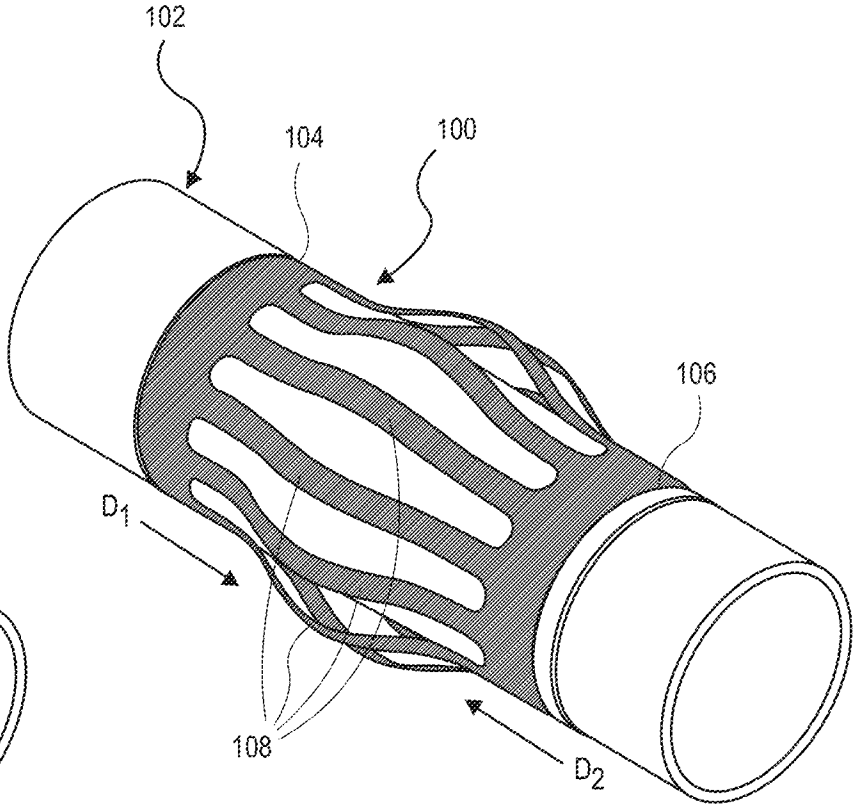
FIGS. 6A and 6B illustrate isometric views of another embodiment of the centralizer in a run-in position and a deployed position, respectively.
Figure 6A:
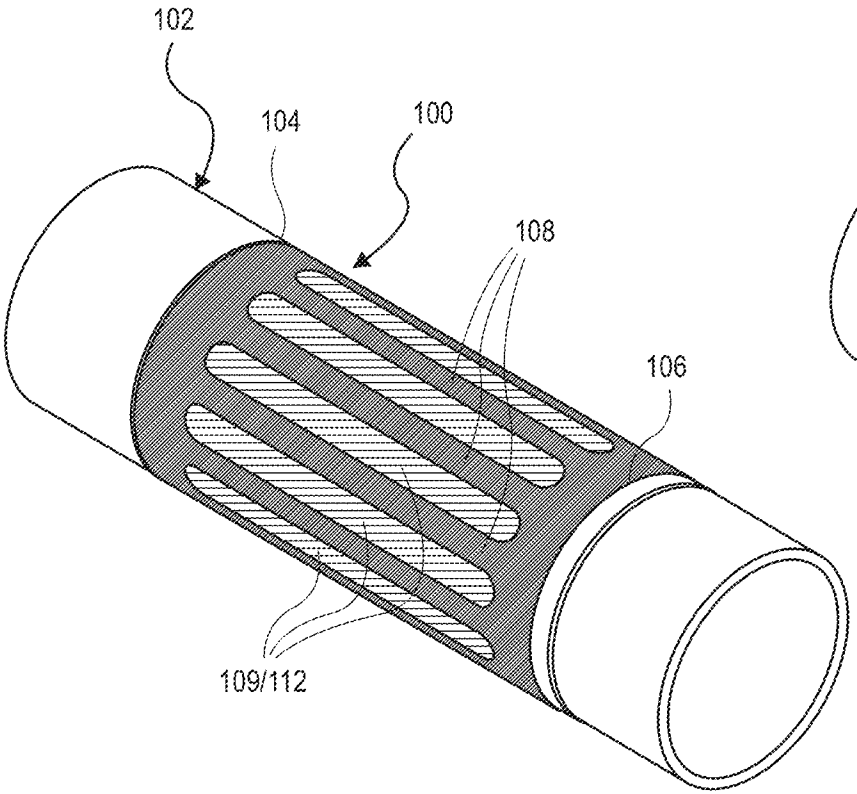

FIG. 6A illustrates an isometric view of another embodiment of the centralizer 100 in the flat or run-in position. FIG. 6B illustrates an isometric view of this embodiment of the centralizer 100 in the deployed position. As shown in FIG. 6A, the dissolvable retention member 112 may hay have length equal or approximately equal to the axial separation between the first and second end collars 104, 106. For example, the dissolvable retention member 112 may include a spacer bar extending between and bearing on the first and second end collars 104, 106. The spacer bar/dissolvable retention member 112 may be retained circumferentially between the bow-spring members 108, e.g., in the slot 109. In some embodiments one, some, or all of the slots 109 may be provided with a spacer bar, and in some embodiments, one or more of the slots 109 may not include such a spacer bar. Further, the spacer bar/retention members 112 may be bonded or otherwise coupled to the tubular 102, or may be coupled to the end collars 104, 106 and positioned, without being secured to, the tubular 102.

As shown in FIG. 6B, upon the dissolvable retention member(s) 112 dissolving, the first end collar 104 and/or the second end collar 106 may be freed to move towards each other, allowing the bow-spring members 108 to expand outwards such that the centralizer is actuated into the deployed position.

Figure 7A:
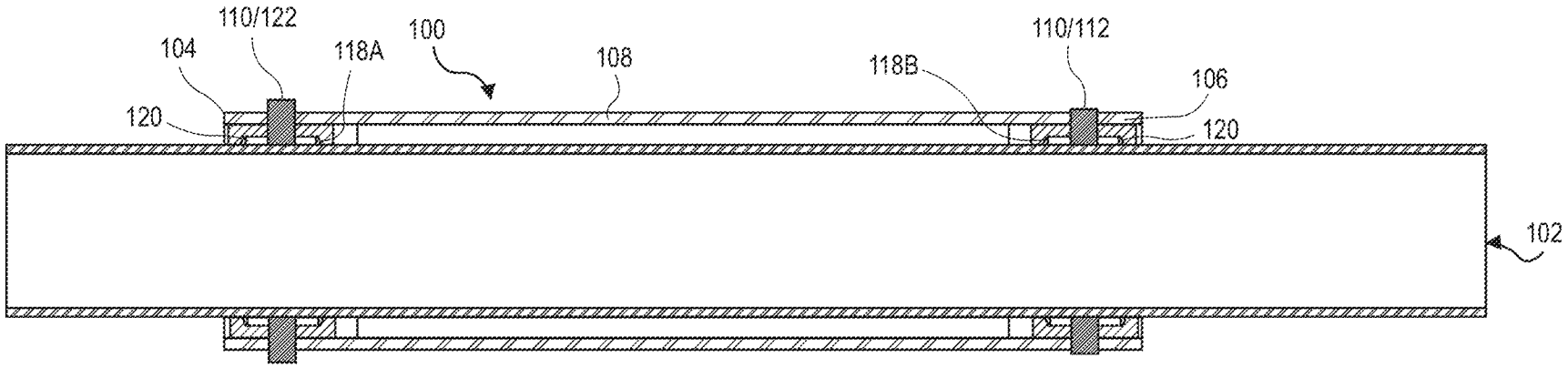
FIGS. 7A and 7B illustrate side, cross-sectional views of another embodiment of the centralizer in a run-in position and a deployed position, respectively.
Figure 7B:
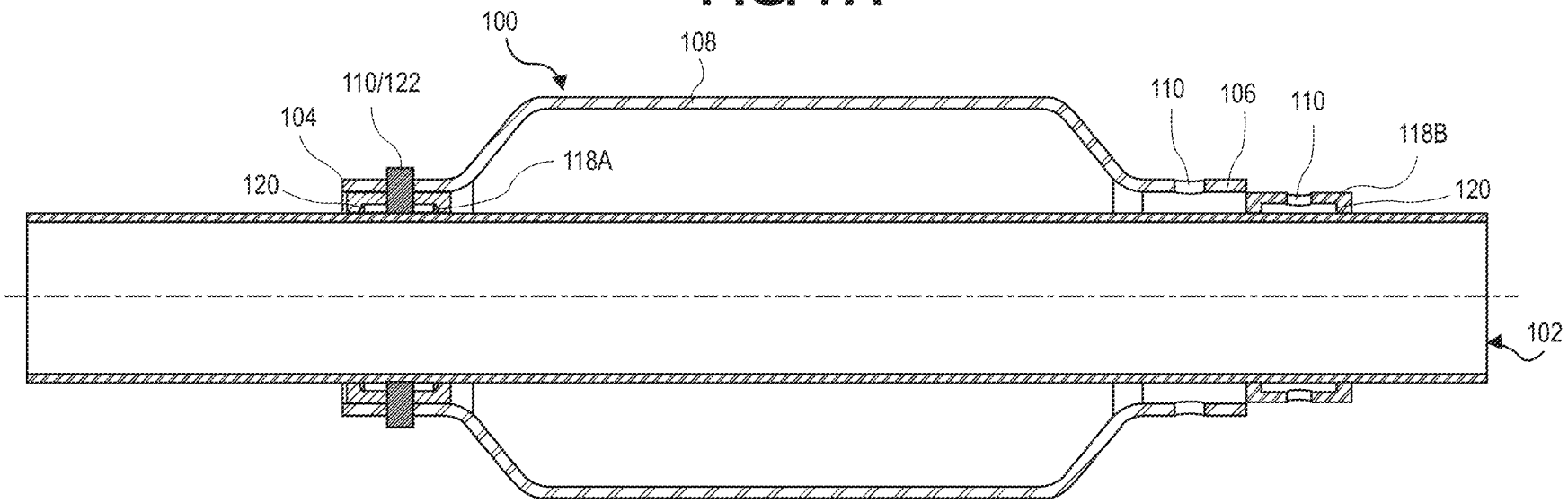

FIG. 7A illustrates a side, cross-sectional view of another embodiment of the centralizer 100 in the flat or run-in position. FIG. 7B illustrates a side, cross-sectional view of this embodiment of the centralizer 100 in the deployed position. In this embodiment, the centralizer 100 may include sleeves 118A, 118B. The first end collar 104 may be received over and coupled to the sleeve 118A, and the second end collar 106 may be received over and coupled to the sleeve 118B. For example, the second end collar 106 may be secured to the sleeve 118B via the one or more dissolvable retention members 112 (e.g., pins), which are received at least partially into the sleeve 118B. The first end collar 104 may be secured to the sleeve 118A via pins or other structures that are not configured to dissolve in the wellbore, but in other embodiments, may be secured via dissolvable members.

In turn, the sleeves 118A, 118B may be fixed to the tubular 102. For example, each of the sleeves 118A, 118B may include a bonding cavity 120. The bonding cavity 120 may be a hollow are in the sleeve, with a radial-inside that is open. A bonding agent (e.g., epoxy) may be received into the bonding cavity 120 and may substantially fill the bonding cavity 120. Once cured, the bonding agent may become part of the sleeves 118A, 118B, and may secure the sleeves 118A, 118B to the tubular 102. Since the end collars 104, 106 are attached to the sleeves 118A, 118B, the sleeves 118A, 118B may thus secure the centralizer 100 in place on the tubular 102.

Referring to FIG. 7B, upon the dissolvable retention member(s) 112 dissolving, the second end collar 106 may be freed from connection with the sleeve 118B and may move towards the first end collar 104, allowing the bow-spring members 108 to flare radially outwards into the deployed position, as shown.

Figure 8A:
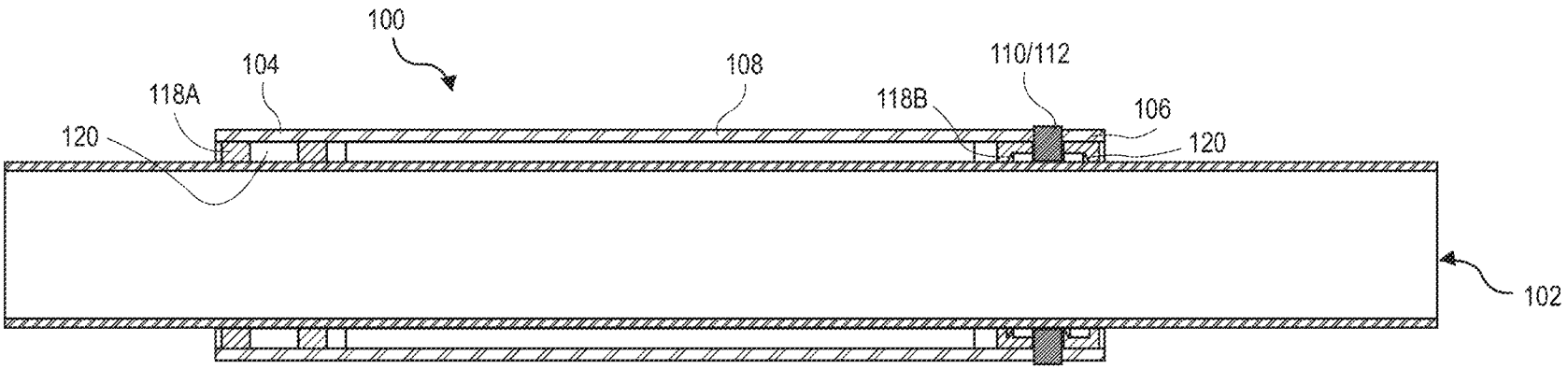
FIGS. 8A and 8B illustrate side, cross-sectional views of another embodiment of the centralizer in a run-in position and a deployed position, respectively.
Figure 8B:
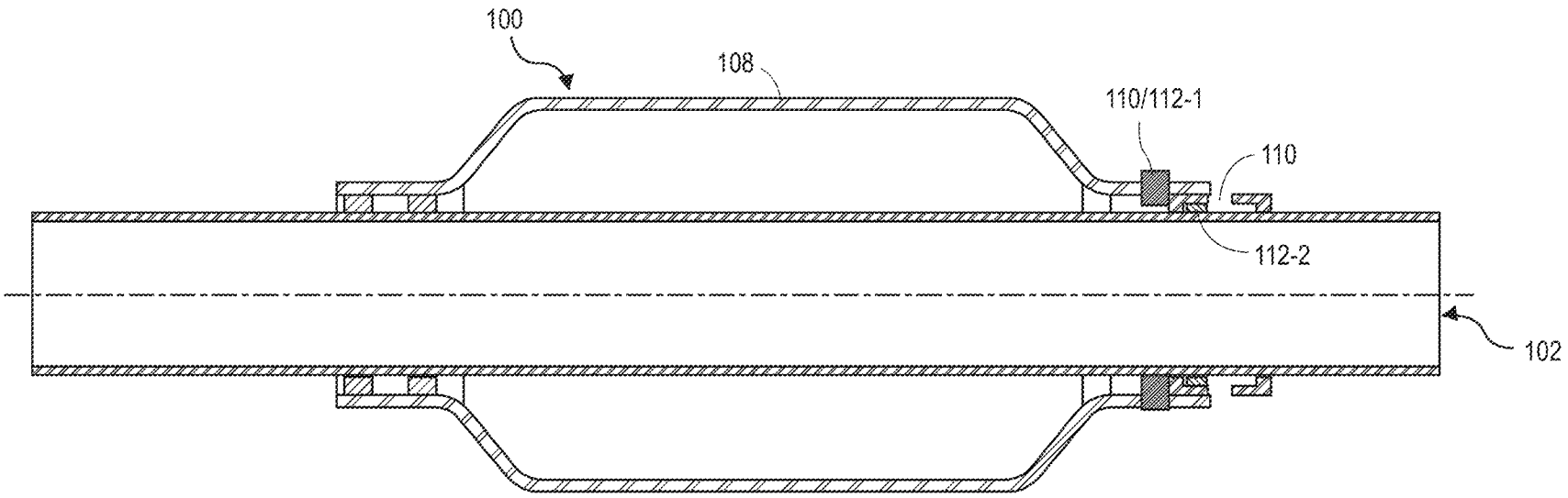

FIG. 8A illustrates a side, cross-sectional view of another embodiment of the centralizer 100 in the flat or run-in position. FIG. 8B illustrates a side, cross-sectional view of this embodiment of the centralizer 100 in the deployed position. The centralizer 100 may include the sleeves 118A, 118B, similar to the embodiment shown in FIGS. 7A and 7B. However, as shown in FIG. 8A, the first end collar 104 may form the radial outside/outer wall (or "top") of the sleeve 118A. As such, the first end collar 104 defines a part of the bonding cavity 120. Accordingly, when the bonding agent is received into the bonding cavity 120, the first end collar 104 is bonded directly to the tubular 102 via the cured bonding agent.

Referring to FIG. 8B, the dissolvable retention member(s) 112 dissolving, the second end collar 106 may be freed to move towards the first end collar 104, allowing the bow-spring members 108 to flare radially outwards into the deployed position.

In any of the foregoing embodiments (or others), the dissolvable retention members 112 may not dissolve entirely in order for the centralizer 100 to actuate into the deployed position. For example, the dissolvable retention member 112 may dissolve to the point where the elastic sheer force of the bow-spring members 108 exceeds the sheer force tolerance of the dissolvable retention member 112, thereby yielding what remains of the dissolvable retention members 112. As shown in FIG. 8B, for example, a first portion of the dissolvable retention member (e.g., first portion 112-1) may remain within the second end collar 106, and a second portion the dissolvable retention member (e.g., second portion 112-2) may remain within the sleeve 118B.

Figure 9:
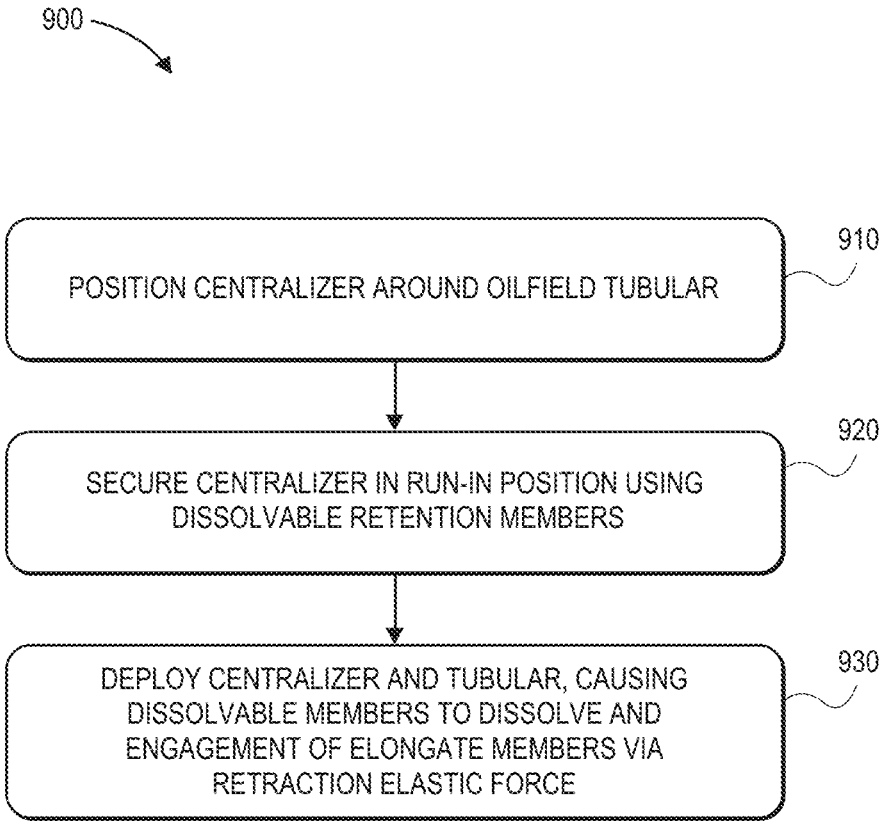
FIG. 9 illustrates a flowchart of a method for deploying a centralizer on an oilfield tubular, according to an embodiment.

FIG. 9 illustrates an example flowchart of a method 900 for deploying a centralizer for centralizing a tubular in a downhole in accordance with aspects of the present invention. The method 900 may be implemented in one or more embodiments shown in FIGS. 1A-8B. In some embodiments, the method 900 may be implemented by any suitable centralizer deploying machinery, downhole or rig equipment, etc.

The method 900 may include positioning a centralizer 100 around an oilfield tubular 102, as at 910. For example, the centralizer 100 may be positioned around the tubular 102 in a flat position or positioned around the tubular 102 and then flattened while on the tubular 102. For example, the first end collar 104 may be pinned to the tubular 102 or the sleeve 118A and the bow-spring members 108 may be elastically stretched over the tubular 102, e.g., until the holes 110 are aligned with the groove 116 on the tubular 102 or in the sleeve 118B.

The method 900 may further include securing the centralizer in run-in position using dissolvable retention members 112, as at 920. For example, the one or more dissolvable retention members 112 may be inserted through the holes 110 and attached to the tubular 102 via the groove 116 in the tubular 102. In some embodiments, the dissolvable retention members 112 may be bonded to the tubular 102, received into the sleeve 118B that is bonded to the tubular 102, or secured between the first and second end collars 104, 106 (e.g., as with the spacer-bar embodiment). In this way, the centralizer 100 is secured in the flat position suitable for being deployed or run in to a downhole. More specifically, the dissolvable retention members 112 may retain and prevent axial movement of the first end collar 104 and/or the second end collar 106 along the tubular 102. As described above, the centralizer 100 may have elastic tension when secured to the tubular 102 via that dissolvable retention members 112, as the bow-spring members 108 seek to spring outwards, but are restrained by the end collars 104, 106 being held apart from one another.

The method 900 may also include deploying the centralizer 100 and tubular 102 into a wellbore, causing the dissolvable retention members 112 to dissolve, and causing radial enlargement of the bow-spring members 108 via retraction elastic force, as at 930. For example, the downhole environment may include a fluid that causes the dissolvable retention members 112 to dissolve, thus allowing the axial distance between the first and second end collars 104, 106 to vary, which in turn allows the bow-spring members 108 to spring outwards into the deployed position. In some embodiments, the dissolvable retention members 112 may be dissolved using any variety of fluids (including wellbore fluids, acids, etc.). Additionally, or alternatively, the dissolvable retention members 112 may be dissolved using other materials or techniques (e.g., using a heat source.). In some embodiments, dissolving of the dissolvable retention members 112 cause the bow-spring member 108 to engage a surrounding tubular (e.g., a wall of the wellbore, liner, casing, etc.) by flaring out or extend radially outwards when the first end collar 104 and the second end collar 106 move towards each other.

As described herein, the centralizer 100 may be relatively low-profile (e.g., having a relatively small positive outer diameter) by being retained in the flat position, thus allowing the centralizer 100 to accommodate and fit through various restrictions that may be present in a downhole (e.g., liner hangers, under-reamed sections, wellbore cave-ins, etc.). In addition to providing the flexibility to accommodate restrictions, the centralizer 100, described herein, may provide sufficient centralizing force/range for maintaining concentricity.

In some embodiments, one end of the bow-spring member 108 (e.g., at the first end collar 104 or the second end collar 106) may be retained by non-dissolvable members (e.g., pins) such that an attached casing string may be pulled out of the downhole (e.g., rather than pushed out, which may result in a higher level of drag). In some embodiments, by placing lug-shaped dissolvable retention members 112 between the first end collar 104 and the second end collar 106, the centralizer 100 may be partially compressed during run in to reduce starting force, and the downhole end will be free to move further down hole relative to the top as the centralizer 100 enters tighter restrictions at a much lower load than it would otherwise. In some embodiments, hook load may be used to validate that the centralizer 100 is deployed (e.g., in the deployed position) after an activation fluid (e.g., used to dissolve the dissolvable retention members 112) is circulated within the downhole.

The foregoing description provides illustration and description, but is not intended to be exhaustive or to limit the possible implementations to the precise form disclosed. Modifications and variations are possible in light of the above disclosure or may be acquired from practice of the implementations.

Even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the disclosure.

No element, act, or instruction used in the present application should be construed as critical or essential unless explicitly described as such. Also, as used herein, the article "a" is intended to include one or more items and may be used interchangeably with "one or more." Where only one item is intended, the term "one" or similar language is used. Further, the phrase "based on" is intended to mean "based, at least in part, on" unless explicitly stated otherwise. Further, as used herein, the terms "first" and "second" may be used interchangeably. For example, description of the first end collar 104 may apply to that of the second end collar 106, and vice versa.

What is claimed is:

1. A downhole tool, comprising:

a first end collar configured to be positioned at least partially around a tubular;

a second end collar configured to be positioned at least partially around the tubular;

a plurality of elongate members extending between and connected to the first and second end collars, wherein a slot is defined axially between the first and second end collars and circumferentially between two of the elongate members; and a dissolvable retention member positioned within the slot and contacting the first and second end collars, wherein the dissolvable retention member is configured to prevent the first and second end collars from moving axially toward one another until the dissolvable retention member at least partially dissolves in a downhole fluid, and wherein, when the dissolvable retention member at least partially dissolves, the second end collar is configured to move with respect to the first end collar, and the plurality of elongate members expand radially outwards.

2. The downhole tool of claim 1, wherein the plurality of elongate members comprise bow springs, and wherein, when the downhole tool is in a run-in position, the bow springs are positioned substantially flat against the tubular, and wherein, when the downhole tool is in a deployed position, the dissolvable retention member has at least partially dissolved and the bow springs are curved radially outwards from the tubular.

3. The downhole tool of claim 1, wherein an axial distance between the first and second end collars reduces as the plurality of elongate members expand radially outwards.

4. The downhole tool of claim 1, wherein the dissolvable retention member engages the tubular.

5. The downhole tool of claim 1, wherein the dissolvable retention member extends between and engages the first and second end collars such that the dissolvable retention member maintains an axial separation between the first and second end collars, the axial separation being substantially equal to a length of the dissolvable retention member.

6. The downhole tool of claim 1, wherein the dissolvable retention member contacts opposing axially facing surfaces of the first and second end collars.

7. A system comprising:

a tubular; and a centralizer positioned at least partially around the tubular, the centralizer comprising:

a first end collar;

a second end collar at an opposite distal end of the first end collar;

a plurality of elongate bow-spring members between the first and second end collars, wherein a slot is defined axially between the first and second end collars and circumferentially between two of the elongate bow-spring members; and at least one dissolvable retention member positioned within the slot and contacting the first and second end collars, wherein the at least one dissolvable retention member is configured to retain the centralizer in a flat position and to prevent the first and second end collars from moving axially toward one another until the dissolvable retention member dissolves, and wherein, when the dissolvable retention member dissolves, the plurality of elongate bow-spring members extend radially outwards.

8. The system of claim 7, wherein the first and second end collars move toward one another when the dissolvable retention member dissolves.

9. The system of claim 7, wherein the dissolvable retention member is directly attached to the tubular.

10. The system of claim 7, wherein the dissolvable retention member extends between and engages the first and second end collars.

11. A method comprising:

securing a centralizer in a flat position on a tubular using one or more dissolvable retention members positioned within one or more slots or holes of the centralizer, wherein the one or more slots or holes are defined axially between first and second end collars of the centralizer and circumferentially between first and second elongate members of the centralizer, and wherein the one or more dissolvable retention members contact the first and second end collars and prevent the first and second end collars from moving axially toward one another; and deploying the tubular with the centralizer into well after securing the centralizer in the flat position, wherein the one or more dissolvable retention members dissolve in the well, causing the centralizer to actuate to a deployed position in which the first and second elongate members of the centralizer expand radially outwards from the flat position and engage a surrounding tubular.

12. The method of claim 11, wherein the first and second elongate members comprises bow springs.

13. The method of claim 11, wherein the one or more dissolvable retention members are dissolved by fluid in the well.

14. The method of claim 11, wherein the one or more dissolvable retention members prevent the first end collar of the centralizer from axial movement relative to the tubular.

15. The method of claim 11, wherein the one or more dissolvable retention members are attached to the tubular.

* * * * *